United States Patent [19]

Drzewiecki

[11] 3,980,103

[45] Sept. 14, 1976

[54] FLUIDIC RESISTIVE ELEMENT

[75] Inventor: Tadeusz M. Drzewiecki, Silver Spring, Md.

[73] Assignee: The United States of America as represented by the Secretary of the Army, Washington, D.C.

[22] Filed: Nov. 7, 1975

[21] Appl. No.: 629,817

[52] U.S. Cl. ..... 137/828; 236/93 R; 236/101 R

[51] Int. Cl.[2] ..... F15C 1/04

[58] Field of Search..... 137/828; 236/80 D, 101 R, 236/93 R, 101 C; 138/45

[56] References Cited

UNITED STATES PATENTS

| | | | |
|---|---|---|---|
| 3,091,393 | 5/1963 | Sparrow | 236/80 D X |
| 3,442,278 | 5/1969 | Petersen | 137/828 |
| 3,457,933 | 7/1969 | Craft | 137/831 |
| 3,721,257 | 3/1973 | DeSantis et al. | 137/828 |
| 3,840,177 | 10/1974 | Osheroff | 236/80 D X |
| 3,937,398 | 2/1976 | Waeldner et al. | 236/80 D X |

*Primary Examiner*—William E. Wayner
*Assistant Examiner*—William E. Tapolcai, Jr.
*Attorney, Agent, or Firm*—Nathan Edelberg; Robert P. Gibson; Saul Elbaum

[57] ABSTRACT

A resistive element for a fluidic system having a load and a supply of working fluid at a supply pressure which is a constant independent of temperature. The resistive element comprises a housing, of a relatively low temperature coefficient of expansion material such as a steel, enclosing a pair of coplanar plates of predetermined dimensions and fabricated from a relatively high temperature coefficient of expansion material, such as a magnesium alloy. The adjacent walls of the plates define the sidewalls of a channel for fluid flow. The plates are slidably mounted inside the housing so as to vary the width of the rectangular channel at a constant rate in response to incremental variations in the fluid temperature. The constant variation in channel width keeps the Reynolds number of the fluid passing through the channel at a substantially constant value despite small increments in the fluid temperature about its operating temperature.

10 Claims, 4 Drawing Figures

FLUIDIC RESISTIVE ELEMENT

RIGHTS OF THE GOVERNMENT

The invention described herein may be manufactured, used and licensed by or for the United States Government for governmental purposes without the payment to me of any royalty thereon.

BACKGROUND OF THE INVENTION

1. Field of the Invention

The present invention relates generally to fluidic flow resistive elements and more particularly to a fluidic resistive element for maintaining the Reynolds number associated with the working fluid at a substantially constant value despite small increments in the temperature of the working fluid about its operating temperature.

2. Description of the Prior Art

Fluidic devices, employing a suitable working fluid, have been developed in recent years to perform functions analogous to electronic devices. These devices have been both pneumatic and hydraulic in nature. Although many of the basic principles of fluidics apply equally as well to both gas and liquid operation, there are also important differences between the two modes of operation owing to the radically different physical properties of the working fluids involved. Pneumatic systems are designed to incorporate air or some other gas as a working fluid. The typical liquid used in hydraulic fluidic systems is MIL-H-5606 red oil. MIL-H-5606 red oil, compared to air is of higher density and viscosity but of much lower compressibility. In many hydraulic fluidic systems, the working oil is exposed to a range of temperatures. Accordingly, the viscosity and Reynolds number of the oil will, unlike air, vary drastically at normal operating pressures.

Reynolds number variation is a critical factor in many applications. For example, the gain of hydraulic fluid amplifiers, operating in the lower range of supply pressures, is much more sensitive to Reynolds number changes than equivalent devices utilizing air as the working fluid. For fixed supply pressures, as the oil temperature drops, the Reynolds number and thus the amplifier gain decreases. A similar problem is encountered in the use of hydraulic fluid flow sensors. For fixed supply pressures, as the oil temperature drops, and the Reynolds number decreases, these devices exhibit a marked null-shift.

One possible solution would be to control the temperature of the hydraulic oil. However, such an approach would be extremely difficult and expensive to carry out and limited in application to a single hydraulic fluid.

Instead of compensating for temperature changes in hydraulic oil, the present invention maintains the Reynolds number of the hydraulic oil at a substantially constant level despite small increments in the temperature of the working fluid about the operating temperature of the fluid.

BRIEF SUMMARY OF THE INVENTION

It is therefore one object of the present invention to provide a fluidic element for a fluidic system to substantially reduce or eliminate the Reynolds number variation of the working fluid, when it experiences small increments in temperature about the operating temperature of the fluid.

It is another object of the present invention to provide such an element for innerconnection with any particular fluid amplifier to substantially reduce or eliminate the gain variation of the amplifier when the working fluid experiences small increments in temperature about the operating temperature of the fluid.

It is yet another object of the present invention to provide such an element for insertion in a fluidic circuit to substantially reduce or eliminate the null-shift of a flow sensor associated with the fluidic circuit when the working fluid experiences small increments in temperature about the operating temperature of the fluid.

The objects of the present invention are achieved by a resistive element in a fluidic system having a load and a supply of working fluid at a supply pressure which is a constant independent of temperature. The resistive element comprises a housing including a variable width channel for fluid flow, and means slidably mounted inside the housing responsive to incremental variations in fluid temperature for varying the width of the rectangular channel at a constant rate. The width varying means are a pair of coplanar temperature-expandable plates whose adjacent walls define the side walls of the channel. The constant variation in channel width with temperature keeps the Reynolds Number of the working fluid at a substantially constant value despite small increments in the fluid temperature about its operating temperature.

The foregoing as well as other objects, features and advantages of the present invention will become more apparent from the following detailed description taken in conjunction with the appended drawings.

DETAILED DESCRIPTION OF THE PREFERRED EMBODIMENT

Figure 1:
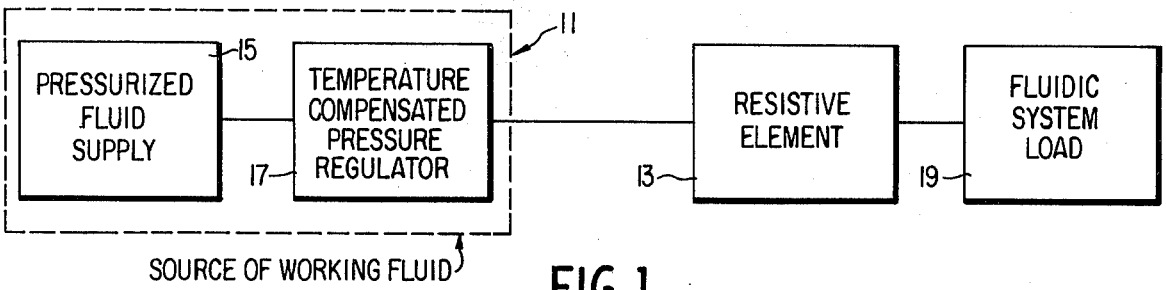
FIG. 1 is a schematic block diagram of a fluidic system incorporating the resistive element of the present invention.

Referring to FIG. 1 there is illustrated in schematic form a fluidic system incorporating the resistive element of the present invention. A source of working fluid 11 supplies the inlet of the resistive element 13 with a pressurized working fluid. For the purpose of the embodiment set forth herein, it will be assumed that the working fluid is a hydraulic oil, such as MIL-H-5606 red oil, although any other suitable working fluid can be used. The source of working fluid consists of a pressurized fluid supply 15 in series with a temperature-compensated pressure regulator 17, a device which is well known to those skilled in the art. The resistive element is connected so as to receive a supply of working fluid from the source and conduct the same to its outlet. After issuing from the resistive element, the fluid flow is directed to the fluidic system load 19 which can be, by way of example, a proportional fluid amplifier. The pressure under which the working fluid is supplied to the fluidic system load is appreciably less than the pressure of the fluid at the input to the resistive element, since the resistance offered to fluid flow by the resistive element is quite high. Therefore the pressure drop across the resistive element will not vary appreciably with temperature.

Figure 3:
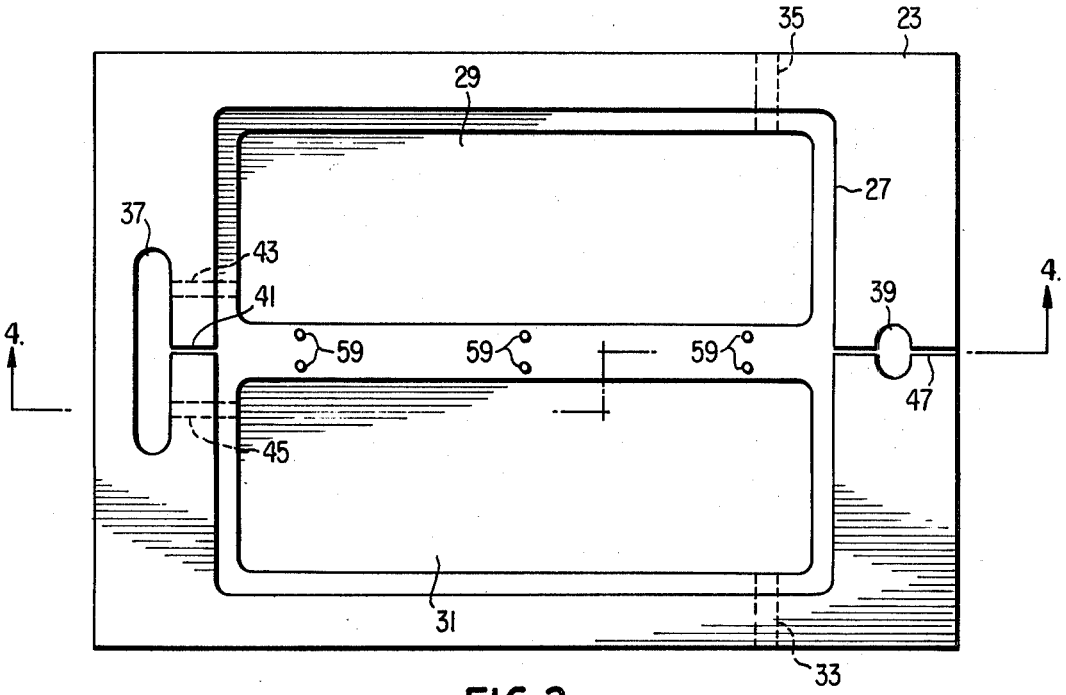
FIG. 3 shows a top plan view of the base plate of the resistive element of the present invention.
Figure 4:
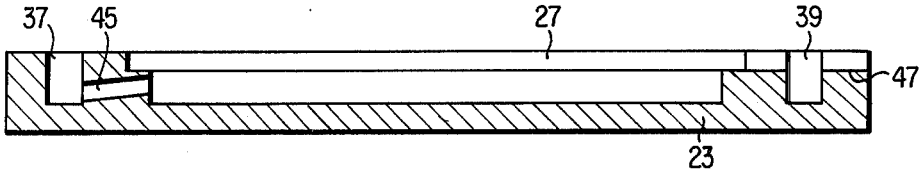
FIG. 4 shows a section view through line 3—3 of FIG. 3 of the base plate of the resistive element of the present invention.
Figure 2:
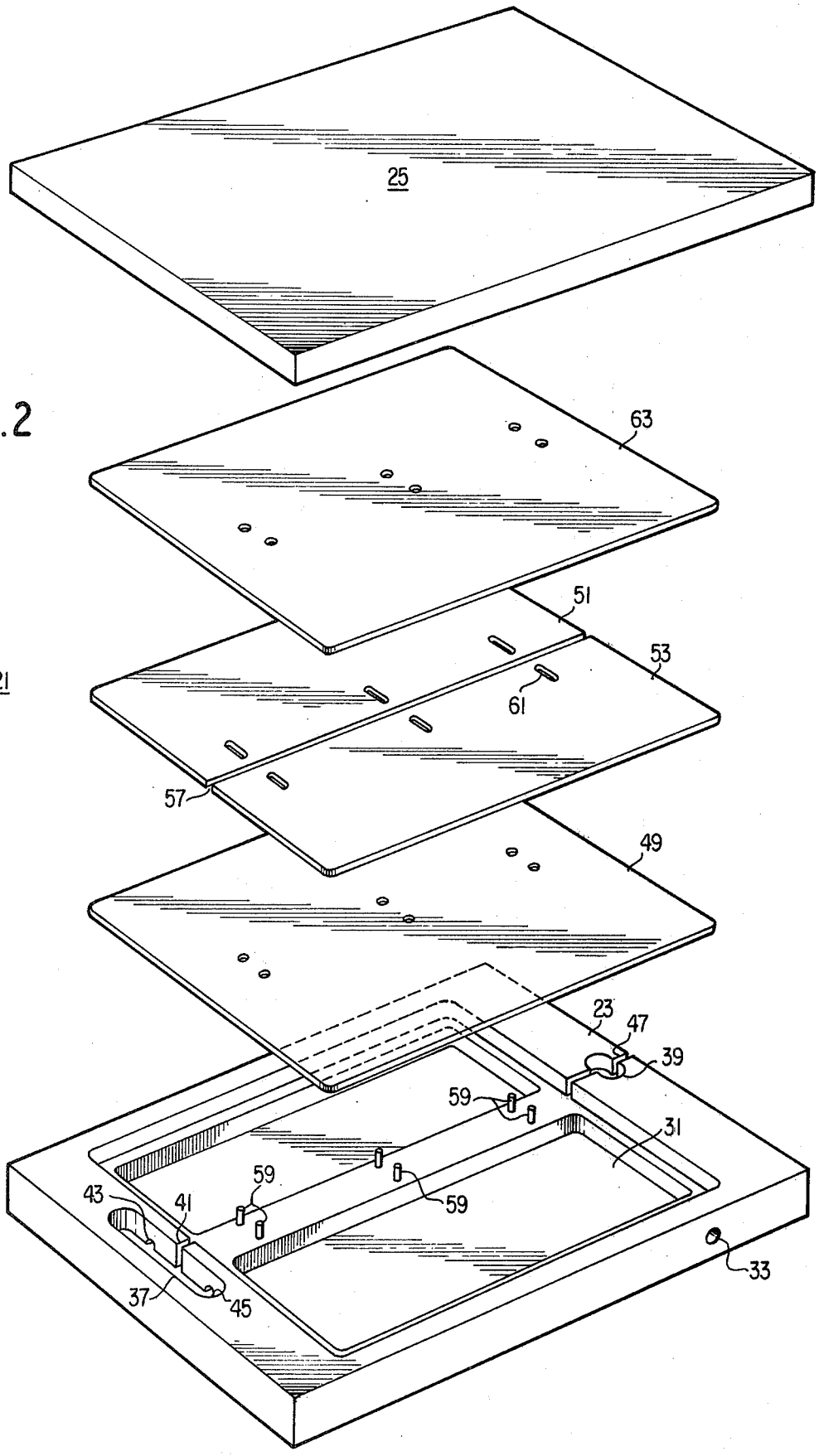
FIG. 2 shows an exploded view of the resistive element of the present invention.

Referring to FIGS. 2, 3 and 4, the resistive element 13 which forms the subject of the invention will now be described in detail. The housing 21 of the resistive element is fabricated from two superimposed flat plates, herein referred to as the base plate 23 and the cover plate 25. In the upper flat face of the base plate 23 there is provided a stepped rectangular recess 27 having an upper step and a lower step. The lower portion of the recess 27 is divided into two smaller rectangular recesses or heat transfer chambers 29 and 31 arranged symmetrically about the base plate's longitudinal axis. Two fluid inlets are provided by conduits 33 and 35 within the base plate 23 connecting openings in the base plate's sidewalls with the heat transfer chambers 29 and 31. Located in the upper face of the base plate 23 at opposite ends of the border of the stepped recess 27 are two cavities or fluid reservoirs 37 and 39 each communicating with the shelf-like upper portion of the stepped rectangular recess by a passage 41 having the same depth as the upper step and running directly above and parallel to the base plate's longitudinal axis. The two heat chambers 29 and 31 are connected by passages 43 and 45 in the base plate 23 to one 37 of the two fluid reservoirs. The other fluid reservoir 39 is provided with an outwardly extending passage 47 serving as the fluid outlet from the base plate 23. A flat seal 49 of smooth material and having substantially the dimensions of the upper portion of the stepped rectangular recess 27 and a thickness less than that of the upper step is disposed in face-to-face contact with the flat bottom of the shelf-like upper portion of the stepped recess. Superimposed on the flat seal 49 are a pair of temperature-expandable plates 51 and 53 symmetrically disposed relative to the base plate's longitudinal axis. The outer ends of the temperature-expandable plates 51 and 53 rest against the upper step and the inner ends are maintained separated so as to define a rectangular channel 57 for fluid flow between the two fluid reservoirs 37 and 39. The temperature-expandable plates 51 and 53 have a high coefficient of linear expansion relative to that of the base plate 23 and are capable of linear expansion parallel to the upper flat face of the base plate. Pins 59 mounted in the base plate 23 and extending through the flat seal 49 engage and hold the temperature-expandable plates 51 and 53 so that the temperature-expandable plates' outer ends rest against the upper step. The pin engaging holes 61 are slotted to permit the inner ends of the temperature-expandable plates 51 and 53 to move in response to increments in the plate temperature, thereby varying the width of the fluid flow channel. A second flat seal 63 identical in all respects to the seal 49 positioned beneath the temperature-expandable plates 51 and 53 covers their top surface. The top of the seal 63 is substantially coplanar with the upper surface of the base plate 23. The two seals 49 and 63 provide a slidable mounting for the pair of temperature-expandable plates 51 and 53. A cover plate 25 is fitted on and secured to the base plate 23 so as to enclose the temperature-expandable plates 51 and 53 in the housing.

In operation of the resistive element 13, fluid is conducted from the exterior of the housing 21 through the two inlets provided by conduits 33 and 35 to the heat transfer chambers 29 and 31 in the base plate 23 and is directed across the slidable mounting for the pair of temperature-expandable plates 51 and 53, thereby heating the temperature-expandable plates to the fluid temperature. The fluid stream exits the heat transfer chambers 29 and 31 by way of the passages 43 and 45 leading to the first fluid reservoir 37. From the first fluid reservoir, the fluid stream is conducted by the passage 41 through the rectangular channel 57 having sidewalls defined by the adjacent edges of the temperature-expandable plates 51 and 53 to the second fluid reservoir 39 whence it is directed by the outwardly extending passage 47 to the exterior of the housing of the resistive element.

The motion of the temperature-expandable plates in response to incremental temperature variation in the working fluid varies the width of the fluid channel at a constant rate and keeps the Reynolds Number of the fluid at a substantially constant value.

Proof of the function of the two expansion plates is best understood from the following analysis, to wit: The Reynolds Number, R, of a fluid of constant density, $p$, flowing through a long, narrow rectangular channel of constant height, $h$, and having a temperature-dependent viscosity, $\nu(T)$, and a temperature-dependent flow $Q(T)$ can be represented by formula A, namely $$R = pQ(T)/h\nu(T). \qquad \text{A.}$$

The objective of maintaining the Reynolds Number at a substantially constant value despite small increments in fluid temperature about the operating temperature, $T_o$, can be accomplished by maintaining the equality represented by formula B, namely $$dR(T_o)/dT = 0. \qquad \text{B.}$$

This requires the equality represented by formula C to hold, namely $$d \log \nu(T_o)/dT = d \log Q(T_o)/dT \qquad \text{C.}$$

The flow Q owes its temperature dependence to that of two quantities: the pressure drop across the resistive element, and the width $b$ of the channel. In a configuration in which the source of working fluid includes a temperature-compensated pressure regulator, the pressure drop across the resistive element will not vary appreciably with temperature. It may be shown, then, that formula C requires the equality represented by formula D and defining the rate of change of channel width with temperature to hold, namely $$db(T_o)/dT = (2/3)b\,(T_o)[d \log \nu(T_o)/dT] \qquad \text{D.}$$

The width of the channel has been assumed much smaller than its height. The width $b$ of the channel can be defined as the difference between $L_1$ the breadth of the upper portion of the stepped recess and the combined breadth of the two expansion plates $2L_2$. If the coefficient of linear expansion of the former is $a_1$ and of the latter $a_2$, formula D requires the equality represented by formula E to hold, namely $$-2(a_2-a_1)L_2(T_o)=(2/3)b\,(T_o)\,[d \log \nu(T_o)/dT] \qquad \text{E.}$$

A resistive element whose parameters satisfy the equality represented by formula E can be designed in accordance with the principles of this invention for each fluid operating temperature $T_o$.

While not to be construed as limiting the present invention, excellent results can be obtained with a resistive element comprising a housing fabricated from Ferro-Nickel, valve steel, seals of Teflon, the tradename for a synthetic resin polymer, and temperature-expandable plates of a typical magnesium alloy operated with MIL-H-5606 red oil at a temperature $T_o$ of 80°F.

The other parameters of the resistive element are as follows:

$b(T_o) = 0.25$ mm.

$h = 2.5$ mm.

$L_2(To) = 125$ mm.

$a_1 = 4 \times 10^{-6}/°C$ $a_2 = 26 \times 10^{-6}/°C$ $a_2 - a_1 = 1 \times 10^{-5}/°F$ $d \log v(T_o)/dT = -0.015/°F$ From the foregoing detailed description, it should therefore be apparent that all the objectives set forth at the outset of the specification have been successfully achieved.

I wish it to be understood that I do not desire to be limited to the exact details of construction shown and described, for obvious modifications can be made by a person skilled in the art.

What is claimed as new and desired to be secured by Letters Patent of the United States is:

1. In a fluidic system having a load and a supply of working fluid at a supply pressure which is a constant independent of temperature, a resistive element comprising:

a housing including a variable width rectangular channel for fluid flow; and means slidably mounted inside said housing responsive to incremental variations in fluid temperature for varying the width of the rectangular channel at a constant rate.

2. The resistive element recited in claim 1 wherein said width varying means includes:

a first temperature-expandable plate; and a second temperature-expandable plate, coplanar with said first temperature-expandable plate, the adjacent edges of said first temperature-expandable plate and of said second temperature-expandable plate defining the side walls of the rectangular channel.

3. The resistive element recited in claim 2 including:

means for heating said temperature-expandable plates to the fluid temperature.

4. The resistive element recited in claim 2 including a plurality of smooth seals enclosed by said housing; and wherein said first temperature-expandable plate and said second temperature-expandable plate are slidably mounted between said smooth seals.

5. The resistive element recited in claim 4 wherein:

said housing includes at least one chamber permitting fluid flow therethrough, said chamber being disposed adjacent one of said smooth seals, for heating said temperature-expandable plates to the fluid temperature.

6. The resistive element recited in claim 2 including a plurality of pins mounted in said housing; and wherein said temperature-expandable plates include a plurality of holes for engaging said pins, said holes being slotted to permit the adjacent ends of said temperature-expandable plates to move in response to incremental variations in fluid temperature.

7. The resistive element recited in claim 2 wherein:

the material of said housing is Ferro-Nickel valve steel.

8. The resistive element recited in claim 2 wherein:

the material of said housing is a steel.

9. The resistive element recited in claim 2 wherein:

the material of said temperature-expandable plates is a magnesium alloy.

10. The resistive element recited in claim 4 wherein:

the material of the smooth seals is Teflon.

* * * * *